US006061929A

United States Patent [19]

Ritter

[11] Patent Number: 6,061,929

[45] Date of Patent: May 16, 2000

[54] FOOTWEAR SOLE WITH INTEGRALLY MOLDED SHANK

[75] Inventor: Brett D. Ritter, Santa Barbara, Calif.

[73] Assignee: Deckers Outdoor Corporation, Goleta, Calif.

[21] Appl. No.: 09/148,306

[22] Filed: Sep. 4, 1998

[51] Int. Cl.[7] ..... A43B 23/00

[52] U.S. Cl. ..... 36/107; 36/108; 36/30 R; 36/31

[58] Field of Search ..... 36/107, 108, 91, 36/30 R, 31, 76 R

[56] References Cited

U.S. PATENT DOCUMENTS

| | | | |
|---|---|---|---|
| 1,281,770 | 10/1918 | Engel . | |
| 2,640,283 | 6/1953 | McCord . | |
| 4,079,526 | 3/1978 | Fukuoka | 36/30 R |
| 4,364,188 | 12/1982 | Turner et al. | 36/30 R |
| 4,419,836 | 12/1983 | Wong | 36/30 R |
| 4,614,046 | 9/1986 | Dassler | 36/30 R |
| 4,667,423 | 5/1987 | Autry et al. . | |
| 4,757,620 | 7/1988 | Tiitola | 36/31 |
| 5,025,573 | 6/1991 | Giese et al. | 36/30 R |
| 5,465,507 | 11/1995 | Schumacher et al. . | |
| 5,720,117 | 2/1998 | Toschi | 36/76 R |
| 5,787,610 | 8/1998 | Brooks | 36/31 |

FOREIGN PATENT DOCUMENTS

| | | |
|---|---|---|
| 7023803 | 1/1995 | Japan . |

*Primary Examiner*—M. D. Patterson
*Attorney, Agent, or Firm*—Juettner Pyle & Piontek

[57] ABSTRACT

A footwear sole comprises a foot-shaped sole of a relatively cushioned, low density polymer foam, with a higher density, harder midfoot shank portion integrally fused within it. The sole may be a unitary footwear sole or may have an outsole or insole adhered thereto. A method of manufacture of the sole comprises forming a polymer foam sole piece, stamping out a portion of the midfoot, forming a shank of higher hardness polymer foam to fit the stamped-out midfoot portion of the sole piece, fitting the shank into the sole piece, and hot compression molding the sole piece and shank to form a unitary, integral sole. The sole of the invention is particularly useful as a sandal sole.

14 Claims, 2 Drawing Sheets

FOOTWEAR SOLE WITH INTEGRALLY MOLDED SHANK

FIELD OF THE INVENTION

The present invention relates generally to soles for footwear, and particularly to sole shanks and methods for fabricating the same.

BACKGROUND OF THE INVENTION

Footwear generally comprises a bottom unit or sole and an upper. The sole may be a single layer or piece, or may comprise two or more layers or pieces. Three layer soles are common, comprising a bottom or outsole, an insole or foot bed, and a midsole therebetween. The sole has a heel portion, forefoot portion and midfoot portion. The upper may be leather or fabric continually adhered to the periphery of the sole, as is the case with shoes and boots. In the case of sandals, one or more straps are attached to the sole at selected points, which straps are adapted to encircle the user's foot.

The weight bearing surfaces of the sole are the heel and forefoot portions. For cushion and comfort, it is desirable to have relatively soft forefoot and heel portions. The midfoot portion of the sole should support the arch of the user's foot, but generally does not touch the ground for both functional and aesthetic reasons. The midfoot portion of the sole thereby acts as a bridge between the forefoot and heel portions of the sole. Accordingly, it is desirable to stiffen the midfoot portion of the sole in order to prevent undesirable reverse flex and promote correct support of the arch. A midfoot stiffening means is a shank.

Shoe soles tend to twist due to natural weight shifting during walking or running. When one walks, the heel is the first portion of the foot to contact the ground. As the step continues and the remainder of the foot contacts the ground, the weight of the body is carried forward along the lateral side of the foot. As the heel leaves the ground, the weight of the body shifts back towards the medial side of the foot. The medial forefoot region near the ball of the foot and the big toe is the last portion of the foot to leave the ground. This weight shifting to the lateral and back to the medial side of the foot during the natural gait exerts torsional forces on the sole and may result in undesirable twisting of the shoe sole. In addition to supporting the user's arch, a midfoot shank also provides torsional rigidity.

The need for a resilient and stiff sole is critical in the case of sandals. For this type of footwear, attachment of the sole to the foot occurs via straps. As these straps are connected to the sole at only a few points, the sandal sole will receive less restraint or control from the top of the foot than will the sole of a shoe or boot which is connected around the entire periphery of the sole. The sandal sole, therefore, should have superior structural integrity to retain a useful shape during use. Without a stiff sole, sandals tend to undesirably "flop" away from the foot and to twist during use. As sandal soles tend to "fold" and twist, a relatively stiff and resilient shank is desirable to insure longitudinal and torsional rigidity, and to allow for a natural stride. The need for a stiff shank is thus particularly acute in the case of sandals, but not limited to sandals.

In the prior art several techniques have been developed to provide a desirably stiff and resilient shanks for shoes and sandals. One type of shank is a metal plate that is inserted either between the midsole and outsole, or between the midsole and insole. The plate bridges the gap between the heel and forefoot regions of the sole. A second type of shank is formed by gluing or molding a plastic component to the midsole or outsole that acts to stiffen the midfoot area. A third type, known as a "fiddle shank," is a laterally narrow section of rubber or other material, commonly molded to the bottom of the outsole. The fiddle shank extends downwardly from the outsole to selectively touch the ground and thereby support the arch region of the foot.

Durable, permanent attachment of the shank to the sole can be a problem, however. Attachment can be achieved through use of an adhesive, by mechanical attachment means, by a secondary molding step, or by insertion of a shank into a pocket within the sole. These means of attachment commonly are disadvantageously subject to delamination or separation due to excessive wear or defective attachment. Also, such means of attachment typically allow some movement of the sole relative to the shank, thereby diminishing desirable stiffening effects of the shank. Also, such means of attachment often requires additional time consuming and costly manufacturing step (s).

Another drawback of prior art shanks is that the shank is often a relatively thin, flat member. The thin, flat configuration is a poor shape to resist torsional and bending forces. It also does not fully support the arch area of the foot because it does not directly contact the arch area.

An unresolved need therefor exists for an improved stiff shank structure for footwear for arch support and torsional rigidity, with a relatively soft forefoot and heel portions of the sole, while maintaining cost effective manufacturing techniques, and which provide durable solutions.

OBJECTS OF THE INVENTION

It is an object of the invention to provide a footwear sole having relatively soft forefoot and heel portions with an integral, relatively stiff shank portion for arch support and torsional rigidity. It is a further object of the invention to provide a sole with an integral shank that is durable and easily and cost effectively manufactured. It is a further object of the invention to provide a facile method of making a footwear sole with a sole having an integral shank.

SUMMARY OF THE INVENTION

The present invention comprises a sole, and more specifically a unitary molded sole, having a relatively soft, low density forefoot and heel portions with a higher density, more rigid shank portion. The two distinct density materials are hot compression molded together to form a structurally integral unit. This hot compression molding step causes chemical cross linking to occur between the shank portion and the forefoot and heel portions. The sole of the invention may be particularly well suited for, but not limited to, use in sandals.

The sole of the invention comprises a molded unit of two or more different densities of thermoplastic or thermosetting polymer compounds. One compound should be of a suitably low density and hardness to provide flexibility and cushion as desired for minimizing shock to the user's foot while walking or running. Near the midfoot region of the sole, underlying the user's arch, is a shank portion comprising a denser, harder, stiffer compound. Because the sole features a relatively low density, cushioned construction in the heel and forefoot regions, it provides excellent comfort. The presence of the higher density, stiffer shank also insures that the arch of the foot will have excellent support. A relatively stiff shank is desirable to lend structure and support to the sole at the midfoot region where the outsole does not touch the ground, to provide a desirable overall stiffness to the sole during walking, and to provide torsional rigidity. The structural effect of the shank may be controlled by varying the hardness of the shank as desired.

A further aesthetic advantage may be achieved by selecting different colors for the shank and remaining portions of the sole. Color selection and molding techniques can produce an attractive two color sole appearance, visually accenting and "calling out" the shank feature.

The sole of the invention is preferably made by compression molding. A sole piece is first pre-formed of a thermoplastic or thermosetting compound, preferably ethylene vinyl acetate ("EVA") foam of a relatively low density. A midfoot portion of a selected size and shape, corresponding to the desired shank portion, is then die cut out of the piece. A higher density shank portion is separately die cut and pre-formed to the same dimensions of the removed piece. The higher density shank portion is then inserted into the opening in the midfoot region of the sole piece. The composite is then hot compression molded together to integrally fuse the shank portion to the rest of the sole. This results in chemical cross linking bonds to be created between the shank and the remainder of the sole. An integral sole is thereby formed having a low hardness and low density forefoot and heel portions with a higher density and higher hardness shank portion.

As the shank is fused in place, it is not subject to delamination or to detachment or to otherwise come apart from the rest of the unit. This represents a significant improvement over the use of adhesives or other means of attachment between the shank and the sole, which often delaminate or otherwise come apart during prolonged use.

The hot compression molding of the sole insures that the top and bottom surfaces of the sole will have the desired contours and texture, without any undesirable ridges or indentations around the perimeter of the shank.

Because the sole of the invention consists of a minimum number of parts that are molded together, manufacture of the sole is relatively easy and inexpensive. No gluing or secondary molding steps are required.

Accordingly, the objects of the invention have been well satisfied. These advantages and others will become more fully apparent from the following detailed description when read in conjunction with the accompanying drawings.

DETAILED DESCRIPTION OF THE INVENTION

Figure 1:
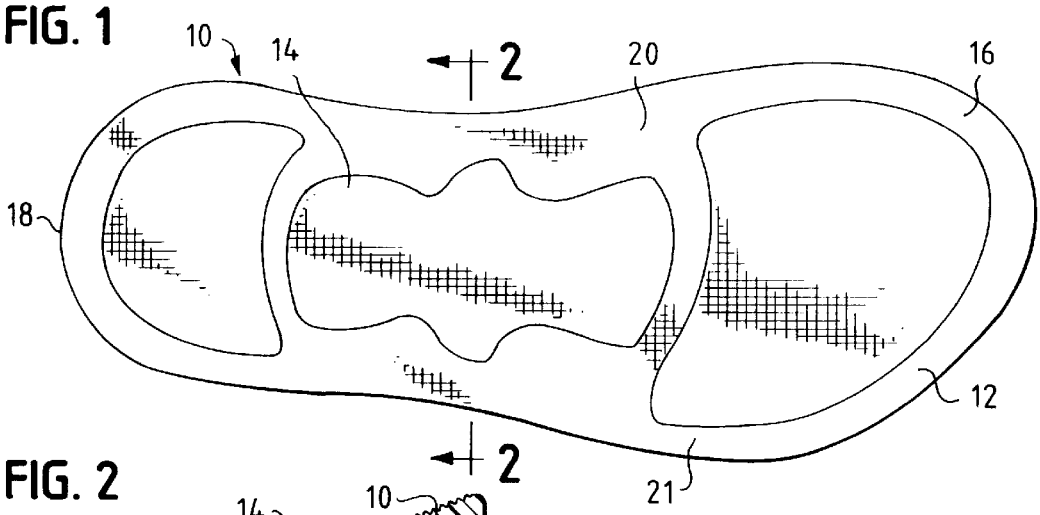
FIG. 1 is a plan view of a first embodiment of a footwear sole having an integrally molded shank of the invention.

Turning now to the drawings, FIG. 1 is a plan view of the sole 10 of the invention. Sole 10 comprises a sole piece 12 and an integral shank 14. The sole piece 12 is generally in the shape of a foot and includes a forefoot portion 16, heel portion 18, medial side 20 and lateral side 21. Sole piece 12 may be comprised of a wide variety of thermoplastic and thermosetting polymer compounds. Ethylene vinyl acetate ("EVA") foam is preferred, but other compounds may be used. The density and hardness of sole piece 12 may be set as desired, with a relatively soft, cushioned consistency desirable for foot comfort. Hardness ranges for sole piece 12 will range between 30 and 60 Shore C hardness, with a preferred hardness of about 55±2 Shore C.

Figure 2:
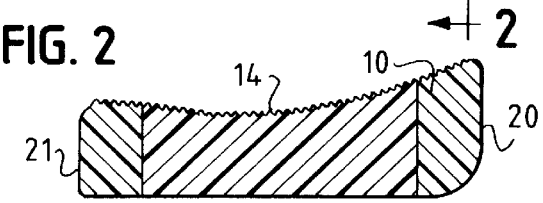
FIG. 2 is a cross-section taken along line 2—2 of FIG. 1.

Shank 14 resides in the midfoot region of sole 10, underlying the user's arch, and bridging the heel and forefoot regions. Shank 14 preferably extends all the way through the sole 10 in a vertical direction, as best seen in FIG. 2. The specific configuration of the shank is not critical, so long it as bridges between the heel and forefoot regions of the sole and provides support for the user's arch. Shank 14 may also be comprised of a suitable thermoplastic or thermosetting polymer compound, with EVA foam preferred. The composition of shank 14 is denser, and hence stiffer and harder, than sole piece 12. Shank 14 will have a hardness range of between 55 and 85 Shore C hardness, with a preferred hardness of about 80±2 Shore C. Preferably a differential of about 20–30 Shore C hardness exists between sole piece 12 and shank 14.

As illustrated in FIGS. 1 and 2, shank 14 is centered near the longitudinal axis of sole 10. Shank 14 extends transversely into the lateral and medial sides of sole 10 to provide torsional rigidity.

Figure 3A:
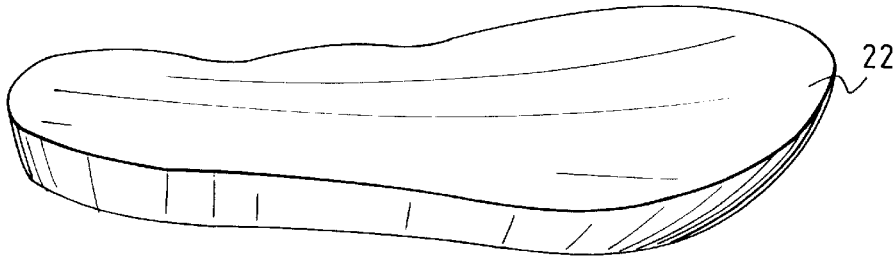
FIGS. 3(*a*) through 3(*c*) are perspective views illustrating the method of the invention for making a sole with an integrally molded shank.
Figure 3B:
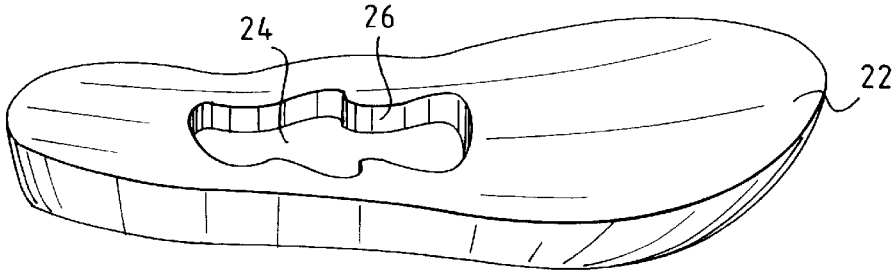
Figure 3C:
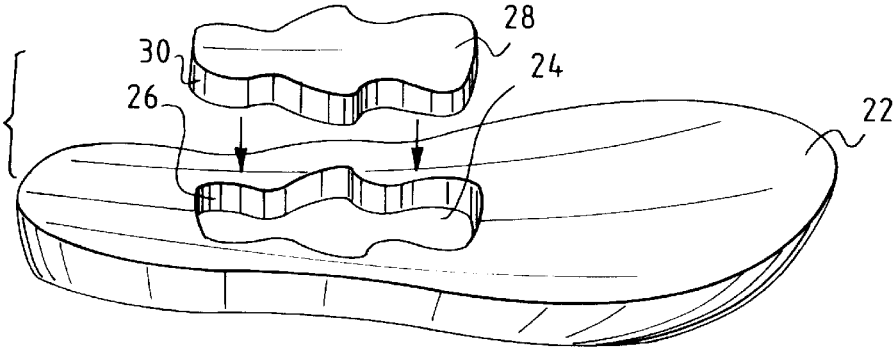

A preferred method of making the sole of the invention generally follows the sequence of FIGS. 3(*a*) to (*c*). The method comprises first forming a sole piece 22 by die cutting the same from a sheet of polymer foam of a desired hardness, between about 30 and 60 Shore C hardness. FIG. 3(*a*). The sole piece is foot-shaped of desired size, but otherwise is flat and rough at this stage. It may preferably be formed of EVA foam by die cutting and mechanical shaping process. The second step is removing a central portion from the midfoot area of the sole piece, in a preselected configuration, leaving a void 24 with side edges 26. FIG. 3(*b*). The void 24 extends vertically all the way through the sole piece. The removing step can be carried out in any conventional manner, such as by die cutting. A shank piece 28 is separately fabricated of a higher hardness, preferably about 20 to 30 Shore C harder than sole piece 22. Shank 28 is preferably formed of EVA foam by die cutting and mechanical shaping to the same dimensions as the void 24 in sole piece 22 so that shank 28 may be inserted into the void 24. Shank 28 has side bonding surface 30.

As the strength of the bond between shank 28 and sole piece 22 will be proportional to the bonding surface area, a preferred embodiment of the shank comprises a shape that maximizes side surface bonding areas 26 and 30. As illustrated in FIG. 3(*c*) shank 28 has rounded front and back ends, and enlarged portions or humps along opposing side edges. It is important to note, however, that any desired shape can be used in accordance with the invention.

The next step in the process is shown in FIG. 3(*c*). Shank piece 28 is inserted into the corresponding void 24 in sole piece 22. Shank piece 28 may be temporarily held in sole piece 22 by friction, or alternatively an adhesive may be applied between surfaces 26 and 30. The assembly is then hot compression molded. The molding process is preferably carried out in a steel mold at temperatures between about 400° to 600° F., under pressure of 10,000 to 35,000 psi, for 1–3 minutes. The molding process fuses the sole piece and shank piece together and imparts desired shapes and contours to the outer surfaces of the unit. In particular, the hot compression molding step causes chemical cross lining to occur between shank piece 28 and sole piece 22 along mating side surface areas 26 and 30, so that the final product is an integral, unitary sole. In this manner the sole of the invention will offer outstanding durability and freedom from delamination or problems that result in a separation of the shank from the sole or bottom unit in general.

The sole of the invention may be used as single sole (bottom unit) or as one of plural soles. If the desired footwear is intended to have a single sole (bottom unit), the hot compression molding step should impart desired treads to the bottom of the sole and a suitable upper surface for contact with the user's foot. Alternatively, the sole of the invention could be used in a two piece sole or bottom unit, with the bottom surface of the sole molded to receive an outsole. The outsole can be attached to the sole of the invention by any conventional means, such as with an adhesive. Likewise, an insole may be attached to the upper surface of the sole of the invention. The sole of the invention may be useful as a sandal sole, or may be used with other types of shoes.

As the shank is integral with and extends through the entire thickness of the sole, it provides for excellent sole stiffness, arch support, and torsional rigidity. In particular, desirable effects on torsional rigidity and sole stiffness are far superior to a thin shank that is located on either the top or bottom surface of the sole. Also, as the shank is integral with sole resulting from the hot compression molding process, it will not move or slip relative to the other portions of the sole. Further, as manufacture of the sole of the present invention involves so few pieces and steps, it offers the valuable advantages of being relatively simple and inexpensive.

Figure 4:
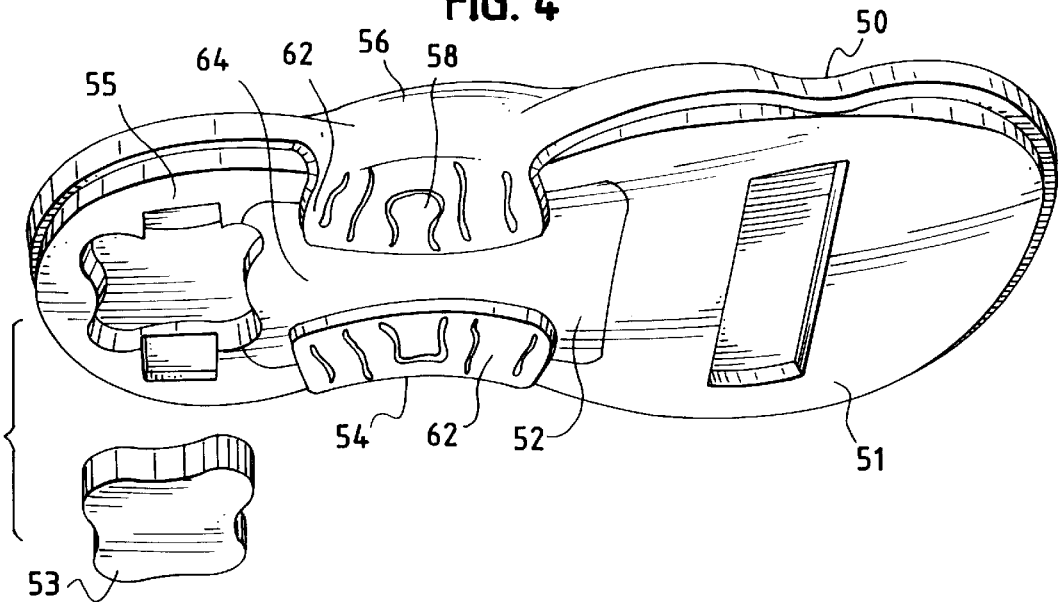
FIG. 4 shows a bottom and medial side perspective view of a second embodiment of a midsole of the invention.
Figure 5:
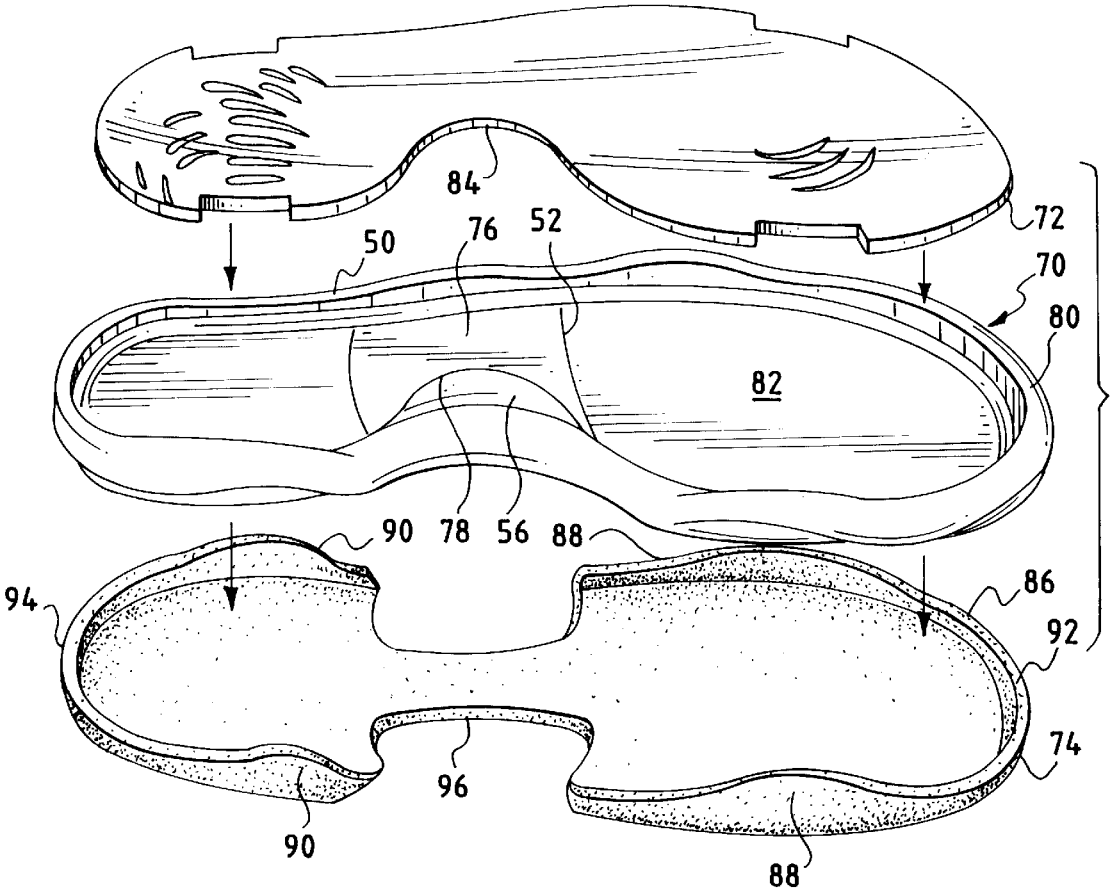
FIG. 5 is an exploded top and medial side perspective view of the second embodiment of the invention.

FIGS. 4 and 5 depict a second embodiment of the invention. FIG. 4 shows a bottom and medial side view of a midsole of the invention. FIG. 5 shows a exploded top and medial side view of the entire sole of the invention. Midsole piece 50 has a bottom surface 51 and an integrally molded midfoot shank 52. Shank 52 is comprised of EVA foam with a hardness of between 55 and 85 Shore C, while midsole piece 50 is comprised of EVA foam with a hardness of between 30 and 60 Shore C, approximately 20–30 Shore C less than shank 52. Preferably, Shank 52 has a hardness of about 80±2 Shore C while the piece 50 has a hardness of about 55±2 Shore C.

Midsole piece 50 has an upwardly arched midfoot 54 that extends laterally across the sole. The medial side of the midfoot has a thicker, raised portion 56 adapted to underlie and support the user's medial arch. The bottom surface of shank 52 is molded to provide two opposing lobes 62 protruding downwardly at the lateral and medial midfoot, and thereby forming a shallow channel 64 between them. The foregoing features, including the arch 54, raised portion 56, lobes 62 and channel 64, are formed when the midsole sole piece 50 and shank 52 are hot compression molded together to form integral midsole 70.

As discussed above and shown in FIGS. 2 and 4, the shank of the invention is located substantially on the longitudinal center line of midsole 50, and extends outward laterally and medially from the center line to provide torsional rigidity. This is particularly important for a sole embodiment such as that illustrated in FIGS. 4 and 5 with upwardly arched midfoot 54. When midsole 50 is at rest on a flat surface, such as the ground, upwardly arched midfoot 54 does not come into contact with the surface. Stiff shank 52 bridges the midfoot from the heel to the forefoot substantially across a transverse cross section of midfoot 54. Accordingly, as illustrated in FIGS. 4 and 5, shank 52 extends transversely well into the lateral and medial sides of midsole 50.

At the center of the heel region 55 is a shock pad 53. Pad 53 is separately formed and inserted into a molded cavity in midsole 50. The function of the pad is to absorb energy from heel strike and release the energy when the user moves forward in a resilient, spring-like manner. The shock pad 53 operates in combination with shank 52 to channel the rebound energy in a forward direction. This combination has been found to provide benefits over either shock pads or integral shanks employed individually.

Turning now to FIG. 5, the midsole 70 is sandwiched between a top sole 72 and outsole 74. Top surface 76 of shank 52 has a raised arcuate portion 78 protruding upwardly on the medial side of the midfoot, underlying the user's medial arch. Integral midsole 70 has a raised perimeter edge 80 and a broad recessed area 82 between edge 80 and the raised arcuate portion 78. Top sole 72 is affixed to the top surface of integral sole 70 as depicted in FIG. 5. Preferred top sole 72 has a shape and thickness that correspond to the recess 82 in the midsole, so that a substantially flush surface results upon attachment of the top sole to the midsole. In particular, top sole 72 has an arcuate indentation 84 at the medial midfoot to match raised portion 78 of the shank. Top sole 72 is preferably comprised of EVA foam with a hardness of 20–40 durometer C. When top sole 72 is in place, the relatively harder shank raised portion 78 is exposed, providing desirably firm support for the user's medial arch, and providing a visual cue as to the presence of the feature and its attendant benefits.

Out sole 74 is comprised of a resilient, rubber like material, or polyurethane, and is attached to the bottom of integral sole 70. Preferred outsole 74 has a raised ridge 86 about its outer perimeter that will wrap around outer, lower edges 87 of the midsole. Preferred outsole raised edge 86 has opposing front side portions 88, opposing rear side portions 90, front end 92, and back end 94 that are raised higher than the remainder of raised edge 86. These regions correspond to areas of increased wear, thereby making presence of durable outsole 74 desirable. Outsole 74 has bridge portion 96 which rests in the shank channel 64 of the midsole, which helps stabilize outsole 74 from lateral movement relative to the midsole.

While preferred embodiments have been shown and described, it is to be understood that various further modifications and additional embodiments will be apparent to those skilled in the art. It is intended that the specific embodiments disclosed are illustrative of the preferred and best modes for practicing the invention, and should not be interpreted as limitations on the scope of the invention as defined by the appended claims.

What is claimed is:

1. A sole having a forefoot, heel, and midfoot there between, a top surface, and having a longitudinal axis, comprising:

a) a foot-shaped piece of a polymer compound of a selected hardness;

b) a shank of a polymer compound within the midfoot of said sole piece and bridging between the forefoot and heel, said shank having a higher hardness than said sole piece, said shank being integrally fused to said sole piece, said shank located on the longitudinal axis of said sole and extending laterally and medially from the axis, and said shank having a raised portion extending upwardly at the medial side of the sole adapted to underlie a user's medial arch; and c) a top sole attached to the top surface of said sole, said top sole having a cutout corresponding to said raised portion of said shank such that said raised portion is not covered by said top sole.

2. A sole as in claim 1, wherein said sole is a sandal sole.

3. A sole as in claim 1, wherein said sole has a bottom surface, said sole further comprising an outsole attached to said sole bottom surface.

4. A sole as in claim 3, wherein said shank has a bottom surface with a longitudinal channel, and said outsole has a longitudinal bridge portion seated within said channel.

5. A sole a in claim 1, further comprising a shock pad in the heel of said sole piece.

6. A sole as in claim 1, wherein said shank and said sole piece are comprised of ethylene vinyl acetate foam.

7. A sole as in claim 1, wherein said shank has a hardness of 55 to 85 Shore C, and said sole piece has a hardness of 30 to 60 Shore C.

8. A sole as in claim 1, wherein said shank has a hardness of about 20 to 30 Shore C hardness greater than said sole piece.

9. A sole as in claim 1, wherein said sole piece and said shank are molded from different color polymer compounds.

10. A sole as in claim 1, said shank extending from a top surface to a bottom surface of said sole piece.

11. A sole as in claim 1, wherein said shank extends transversely substantially across the midfoot.

12. A sole having a forefoot, heel, midfoot therebetween, and a bottom surface, comprising:

a) an outsole attached to the sole bottom surface, said outsole having a longitudinal bridge portion;

b) a foot-shaped sole piece of a polymer compound of a selected hardness; and c) a shank of a polymer compound within the midfoot of said sole piece and bridging between the forefoot and heel, said shank having a higher hardness than said sole piece, and said shank being integrally fused to said sole piece, said shank having a bottom surface with a longitudinal channel, and said outsole longitudinal bridge portion seated within said channel.

13. A sole as in claim 12, further comprising a top sole affixed to a top surface of said sole piece.

14. A sole as in claim 12, wherein the hardness of said sole piece is about 20 to 30 Shore C less than the hardness of said shank.

* * * * *